US007492918B2

(12) United States Patent
Stiles et al.

(10) Patent No.: US 7,492,918 B2
(45) Date of Patent: Feb. 17, 2009

(54) AUDIO SPEAKER WITH GRADUATED VOICE COIL WINDINGS

(75) Inventors: Enrique M. Stiles, Imperial Beach, CA (US); Richard C. Calderwood, Portland, OR (US)

(73) Assignee: Step Technologies Inc., Minneapolis, MN (US)

( * ) Notice: Subject to any disclaimer, the term of this patent is extended or adjusted under 35 U.S.C. 154(b) by 437 days.

(21) Appl. No.: 10/920,534

(22) Filed: Aug. 17, 2004

(65) Prior Publication Data

US 2006/0039578 A1 Feb. 23, 2006

(51) Int. Cl.
*H04R 25/00* (2006.01)

(52) U.S. Cl. ..... 381/409; 381/408; 381/410

(58) Field of Classification Search ..... 381/400–402, 381/406–410

See application file for complete search history.

(56) References Cited

U.S. PATENT DOCUMENTS 3,711,659 A * 1/1973 Bremseth ..... 381/410
4,160,133 A * 7/1979 Wiik ..... 381/401
6,158,109 A * 12/2000 Tanabe et al. ..... 381/409

* cited by examiner

*Primary Examiner*—Suhan Ni
(74) *Attorney, Agent, or Firm*—Richard C. Calderwood

(57) ABSTRACT

An audio speaker driver having a voice coil with graduated windings such that different sections of the voice coil have different electrical resistances and/or lengths per unit of height of the voice coil. A center portion of the voice coil gives a greater BL, while outer portions give lower overall electrical resistance, such that the audio speaker driver is highly efficient and linear during low excursion operation, with a smoother transition from the linear region to the grossly non-linear region. The wire of the graduated voice coil can have varying cross-sectional area over its length, can be wound on varying on-center spacing, can be wound in different numbers of layers in the various sections, and/or it can fork into interlaced, parallel windings.

25 Claims, 10 Drawing Sheets

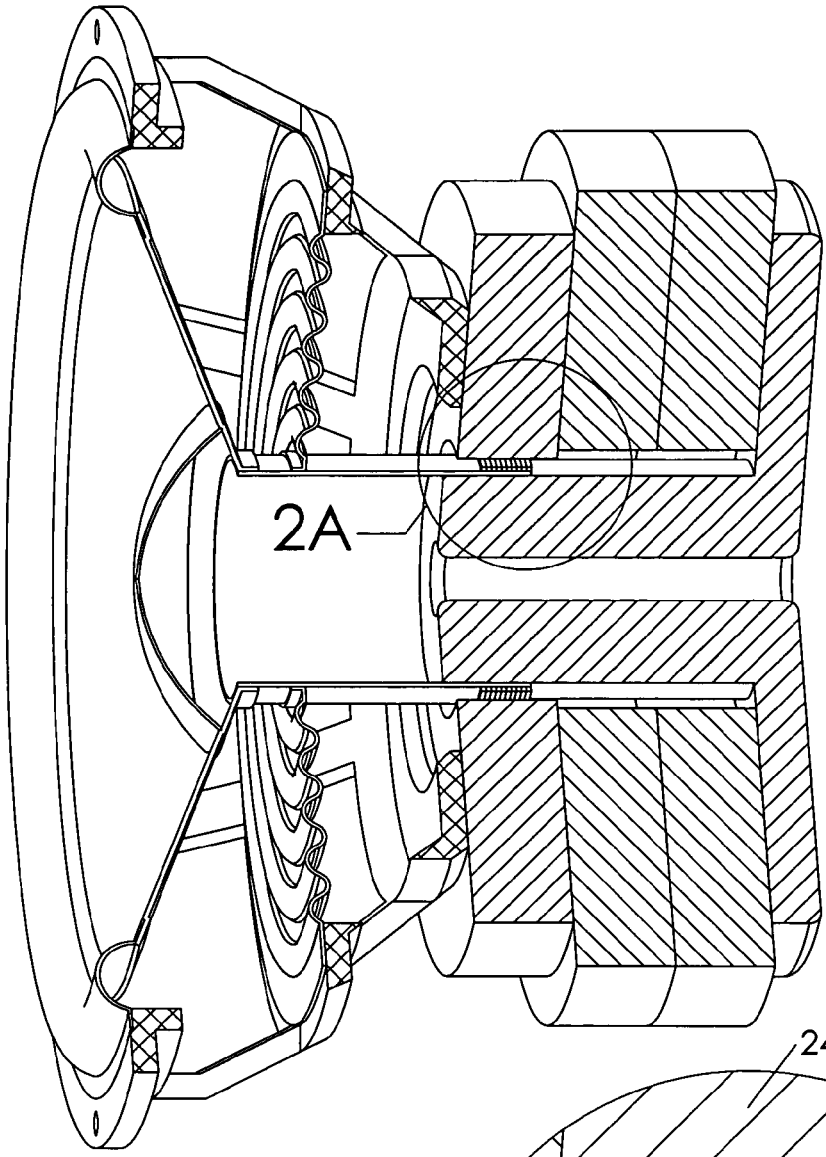
Fig. 2
prior art
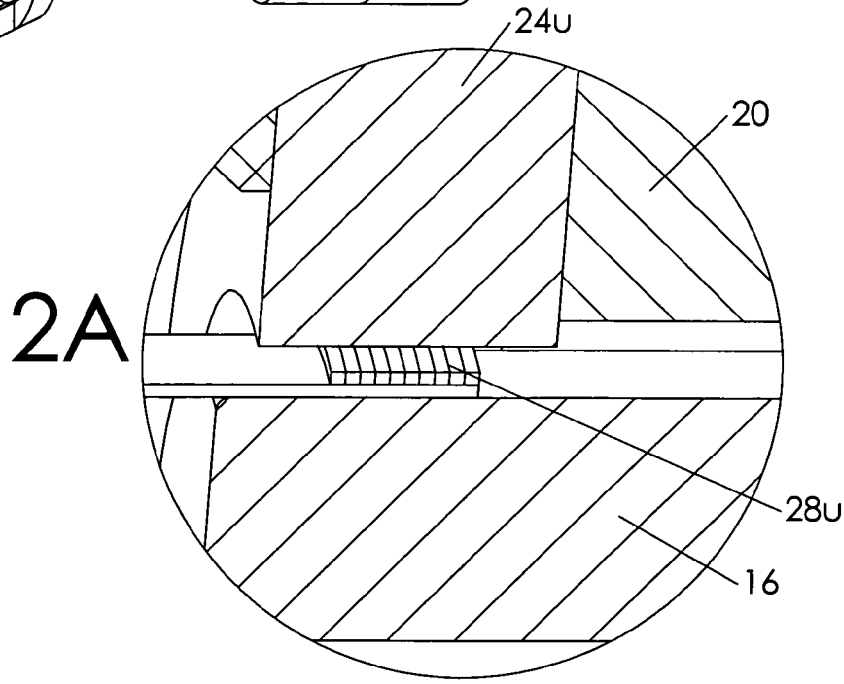

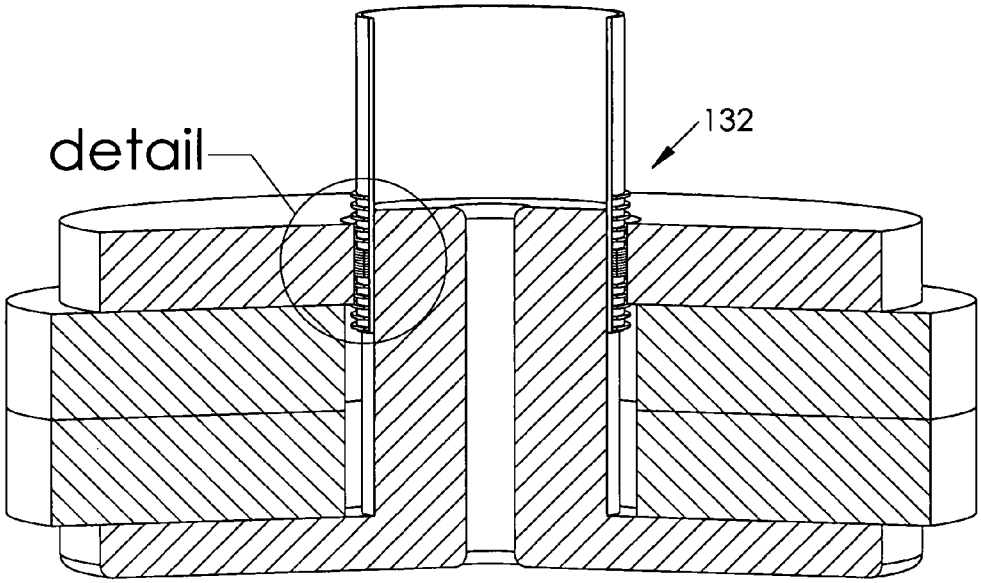
Fig. 14
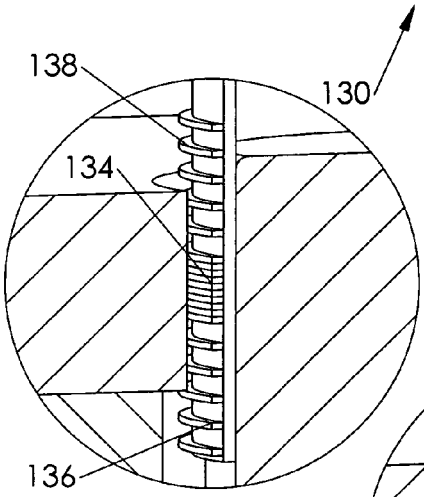
14mid
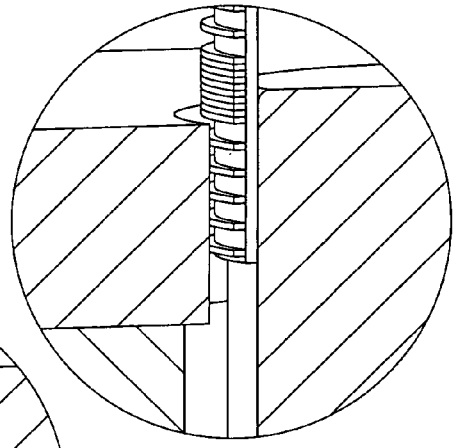
14far
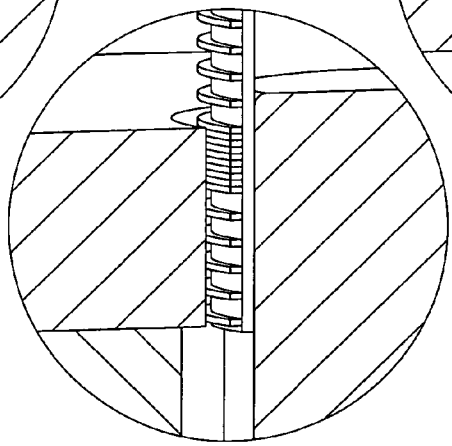
14out

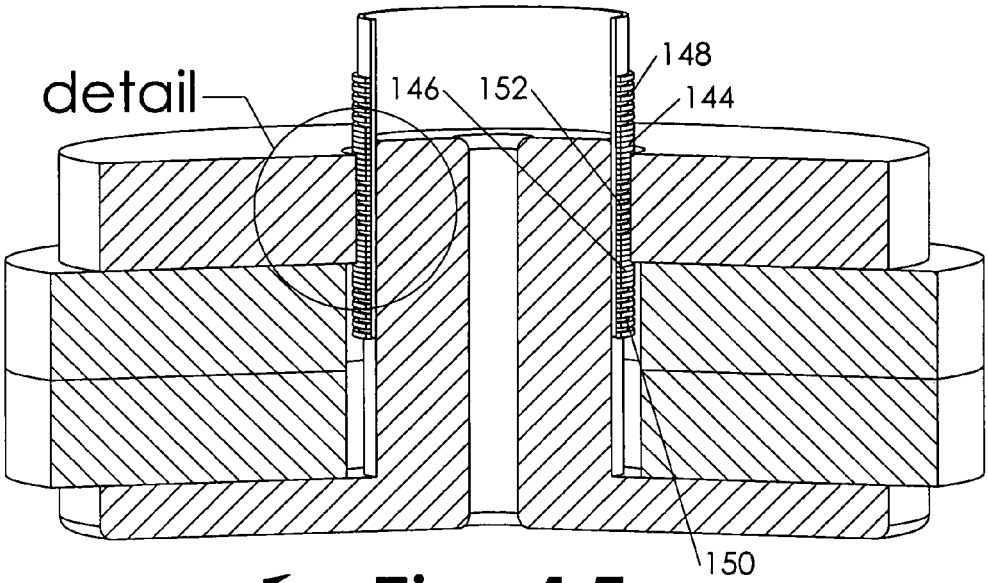
Fig. 15
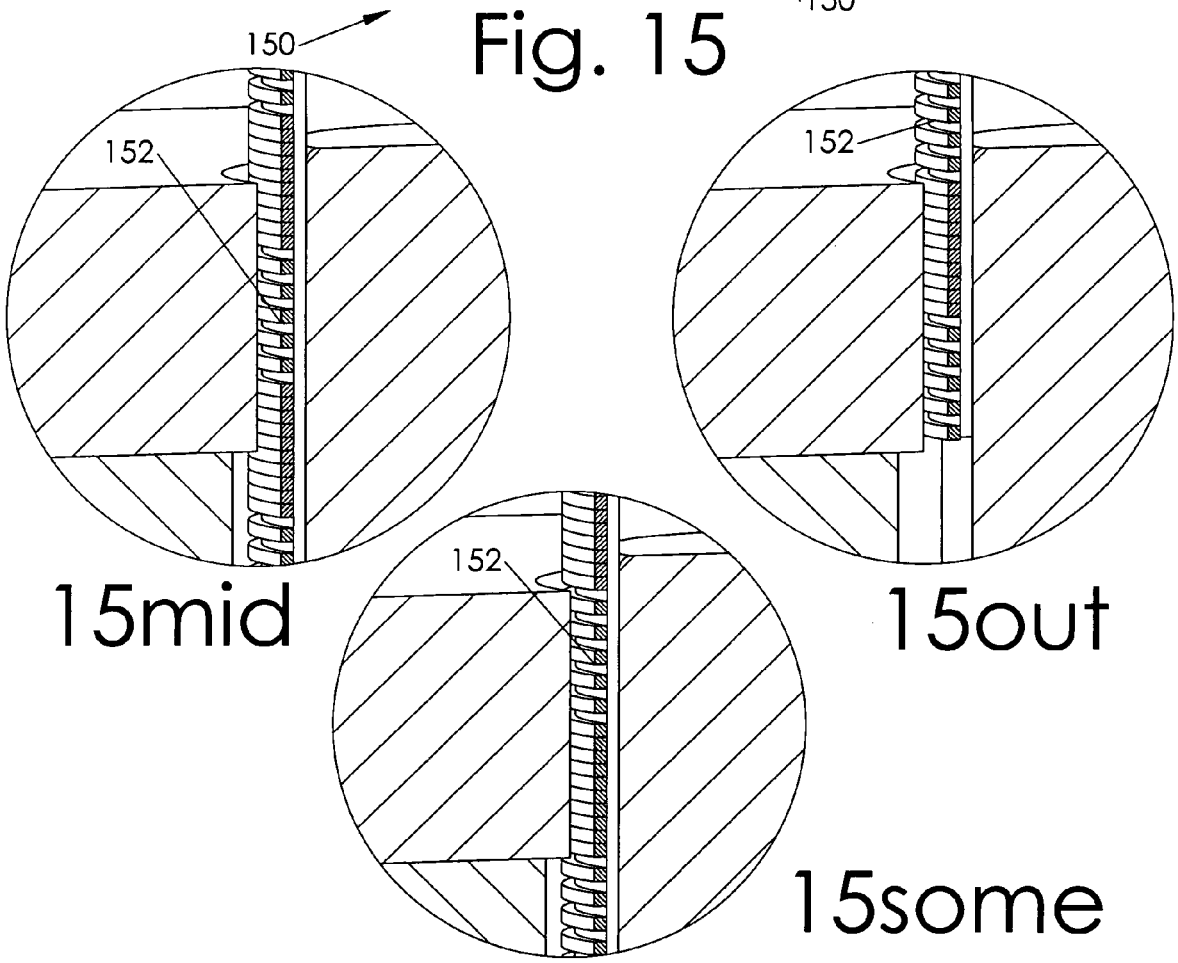

AUDIO SPEAKER WITH GRADUATED VOICE COIL WINDINGS

BACKGROUND OF THE INVENTION

1. Technical Field of the Invention

This invention relates generally to audio speaker driver motor structures, and more specifically to a motor structure having a voice coil with graduated windings in which some winding sections have a different electrical resistance and/or a different wire cross-sectional area per unit of coil height than others, which results in a varied BL along the voice coil winding height.

2. Background Art

FIG. 1 illustrates a conventional overhung speaker driver 10*o* such as is known in the prior art. The speaker driver includes a magnetically conductive pole plate 12 which includes a pole 16 which may be either coupled to or integral with the back plate 14 of the pole plate, as shown. The pole may include an axial hole 18 for permitting airflow to cool the motor structure and depressurize the inner portion of the diaphragm assembly. One or more ring-shaped permanent magnets 20 surround the pole, with a cavity 22 between the magnets and the pole. A magnetically conductive top plate 24*o* surrounds the pole, with a magnetic air gap 26 between the top plate and the pole. The pole plate, magnet(s), and top plate may collectively be termed a magnet assembly or a motor structure.

An electrically conductive, overhung voice coil 28*o* is rigidly attached to a cylindrical bobbin or voice coil former 30. The voice coil is suspended within the magnetic air gap such that, when energized with an electrical current, it will provide mechanical force to a diaphragm 32 which is coupled to the bobbin. When the energizing current which is passed through the voice coil is an alternating current, the voice coil moves up and down in the air gap along the axis of the speaker driver, causing the diaphragm to generate sound waves.

A frame 34 is coupled to the motor structure. Two suspension components couple the diaphragm assembly to the frame: a damper or spider 36 is coupled to the bobbin and the frame, and a surround 38 is coupled to the diaphragm and the frame. These two suspension components serve to keep the bobbin and diaphragm centered and aligned with respect to the pole, while allowing axial movement. A dust cap 40 seals the assembly and protects against infiltration of dust particles and other stray materials which might contaminate the magnetic air gap and thereby interfere with the operation or quality of the speaker driver.

When, as shown, the voice coil is taller (along the axis of the motor structure) than the magnetic air gap, the speaker driver is said to have an overhung geometry.

FIG. 2 illustrates a conventional underhung speaker driver 10*u*. The motor structure of the speaker driver includes permanent magnet(s) 20, a top plate 24*u*, and a pole 16*u*. The voice coil 28*u* is shorter (along the axis of the motor structure) than the magnetic air gap.

FIG. 3 illustrates a conventional equalhung speaker driver 10*e*. The motor structure of the speaker driver includes permanent magnet(s) 20, a top plate 24*e*, and a pole 16*e*. The voice coil 28*e* has substantially the same height (along the axis of the motor structure) as the magnetic air gap.

In any of these geometries, if the voice coil moves so far that there exists a different number of voice coil turns within the air gap (i.e. an overhung voice coil has moved so far that one end of it has entered the air gap, or an underhung voice coil has moved so far that one end of it has left the air gap, or an equalhung voice coil has moved), the speaker driver begins to exhibit nonlinear characteristics, and the sound quality is distorted or changed. This is especially problematic when producing low frequency sounds at high volume, which require long voice coil travel.

The common approach to solving this problem has been to use highly overhung or highly underhung geometries to achieve a high degree of linear voice coil travel. These approaches have inherent limitations, however. The highly overhung motor requires increasingly longer coils, which in turn increases the total moving mass of the diaphragm assembly and increases the DC resistance of the voice coil, assuming the same gauge wire is used. At some point, this ever-increasing mass becomes so great that the inherent mechanical stability design limits are reached, which prevents any further controllable increase in excursion. At the same time, increasing the voice coil mass with no resultant increase in utilized magnetic flux will reduce the overall efficiency of the speaker driver. Efficiency is proportional to BL squared, and inversely proportional to mass squared. Efficiency is also inversely proportional to the total electrical resistance of the voice coil. In the highly underhung geometry, other practical limits are reached because of the relative increase in magnet area required to maintain a constant B across a taller magnetic gap height in order to achieve higher linear excursions without sacrificing efficiency. Unfortunately, this increase in total magnetic flux (to achieve the same B) does not result in an increase in BL; in this case, the larger diameter magnets simply enable a taller magnetic air gap and greater Xmax, with no efficiency gain.

Presently, voice coils are wound with wire having the same cross-section (i.e. diameter) over the entire length of the voice coils, and with a substantially constant packing density over the voice coil height.

What is needed is an improved voice coil which provides increased travel and a less abrupt transition into non-linearity behavior.

BRIEF DESCRIPTION OF THE DRAWINGS

The invention will be understood more fully from the detailed description section given below and from the accompanying drawings of embodiments of the invention which, however, should not be taken to limit the invention to the specific embodiments described, but are for explanation and understanding only.

FIGS. 1-3 show, in cross-section, conventional speaker drivers according to the prior art, having overhung, underhung, and equalhung voice coils, respectively.

FIG. 14 shows, in partial cross-section, another embodiment of a speaker driver motor structure in which an overhung voice coil includes an underhung center portion.

FIG. 15 shows, in partial cross-section, another embodiment of a speaker driver motor structure in which voice coil includes multiple loosely wound and tightly wound portions, providing the possibility of increased Xmax.

DETAILED DESCRIPTION

Figure 1:
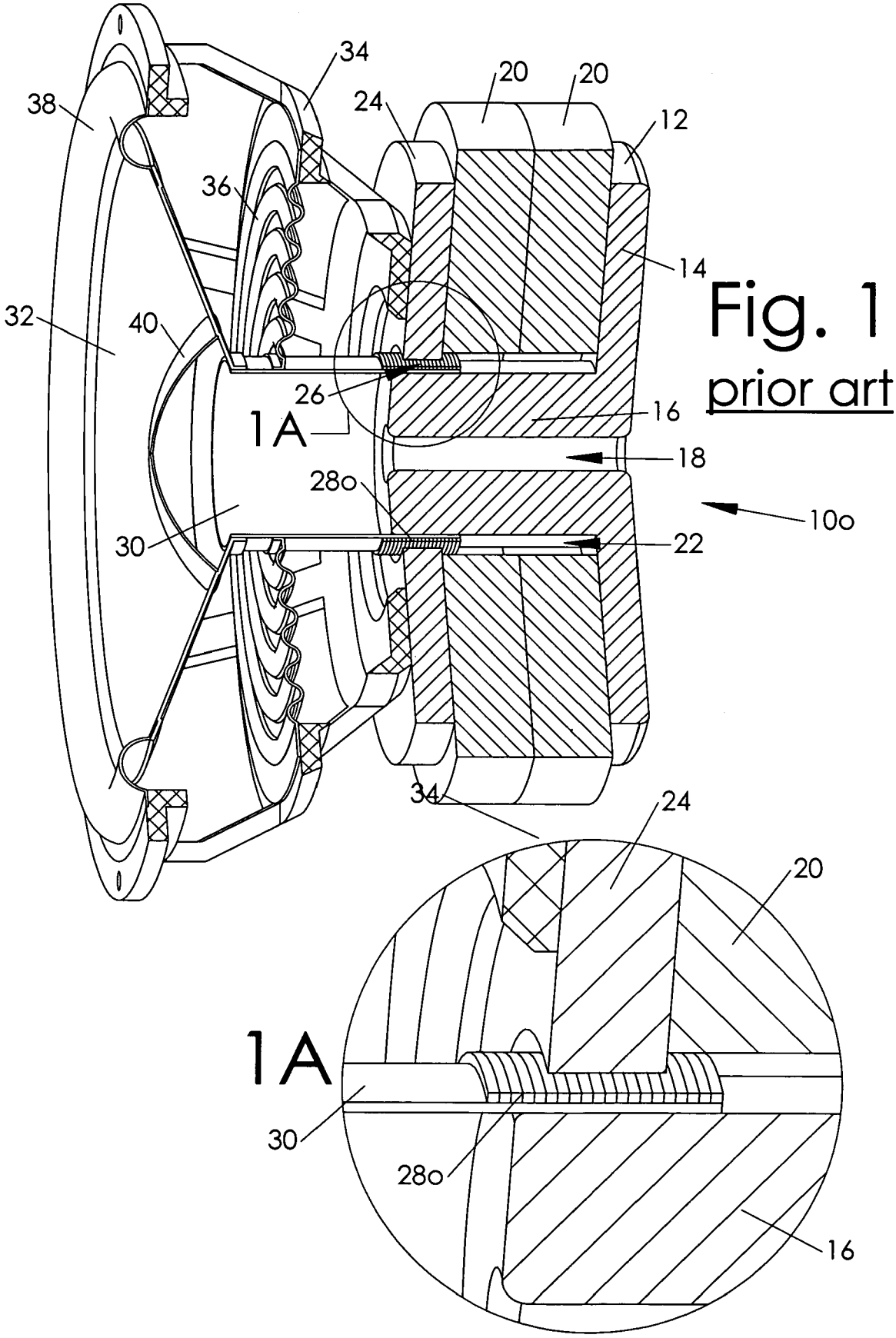
Fig. 1 prior art
Figure 3:
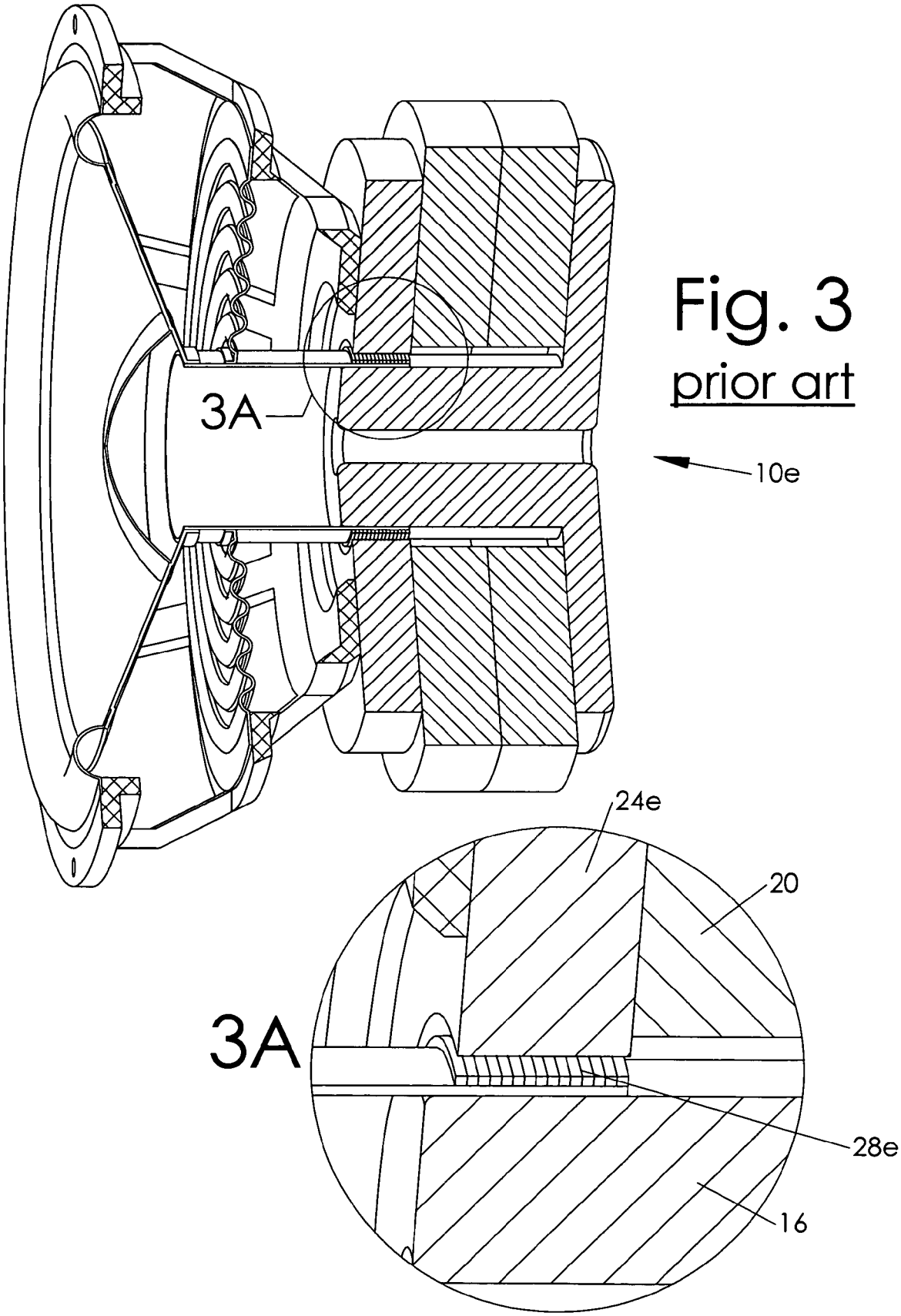
Fig. 3 prior art
Figure 4:
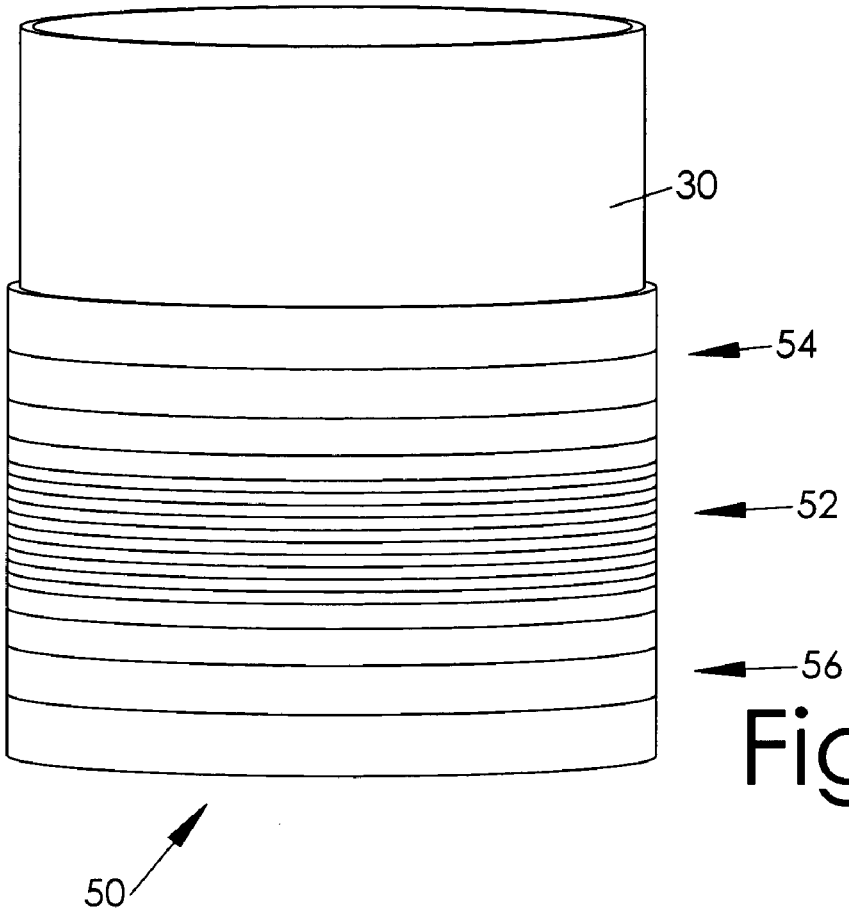
FIG. 4 shows one embodiment of a voice coil having graduated windings according to this invention, in which the wire has a non-uniform cross-section over its length. Such a voice coil may be utilized in FIGS. 5-7.

FIG. 4 illustrates one embodiment of a graduated voice coil 50 according to this invention. The voice coil is wound around a bobbin 30, and includes a primary group of windings 52, and one or more secondary groups of windings 54, 56. The primary group of windings are wound at a particular on-center spacing, and the secondary groups of windings are wound on a looser on-center spacing. In other words, there are more primary windings per axial unit of distance than there are secondary windings. However, the wire in the secondary windings has a significantly larger cross-sectional area than do the primary windings, and thus a lower electrical resistance per winding. The various sections of wire in a given voice coil may each have different cross-sectional shapes; for example, the middle section may be made of square wire, while the outer sections may be made of rectangular wire, as shown, or of other shapes such as round wire.

In one embodiment, the wire is simply a tapered, round wire which is thick at the ends and thin at the middle, with the middle constituting the primary windings. In the embodiment illustrated, the wire is a tapered, flat wire, such that the voice coil assembly has a substantially constant outer diameter over its entire length; this may be more complicated to manufacture, but it may offer the advantage of enabling a narrower magnetic air gap and thus a higher magnetic flux density in the gap.

The windings in a particular group may all have the same cross-sectional area, or the cross-sectional area may gradually change across the group. The same can be said of the spacing of the windings. While the wire is shown as having a rectangular cross-section, this should not be construed as a necessary limitation; other shapes may be used, such as circular or elliptical, although the rectangular shape will generally provide the largest percentage of conductor cross-sectional area, or, in other words, the best packing factor, lacking any interstitial spaces. It may, in many instances, be desirable that the wire have a constant width (in the left-right orientation in FIG. 4), or, in other words, that the voice coil have a constant OD, to provide a constant clearance between the voice coil and the gap-defining parts of the motor structure.

The primary voice coil windings are disposed on the bobbin at a location where they will be active under low drive conditions (small excursion). With the thin (or tightly spaced) windings in the magnetic air gap, the total length L of active voice coil is maximized, and the BL or motor strength of the motor is maximized, yielding a higher 1 watt/1 meter efficiency rating for a given voice coil dc resistance (DCR).

Figure 5:
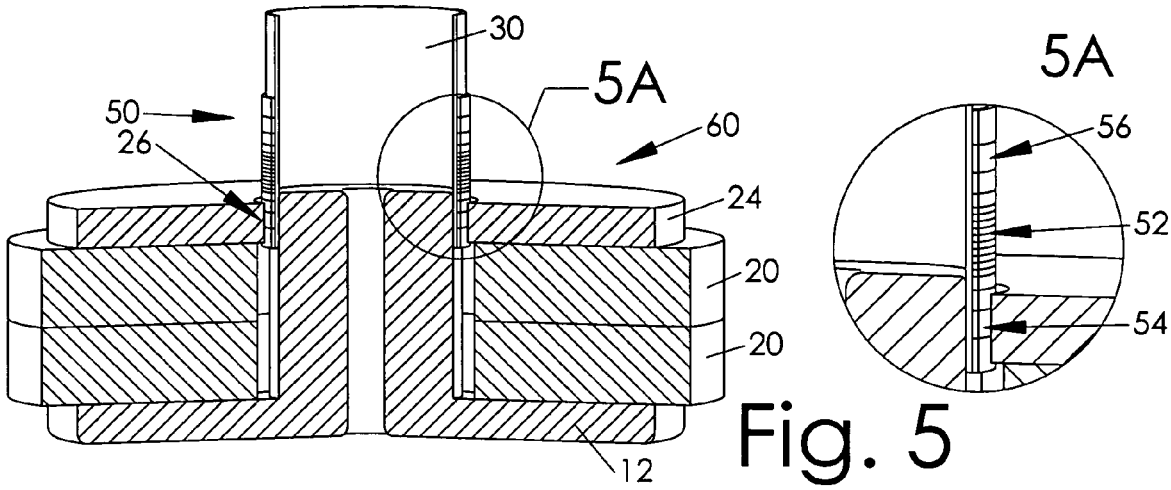
FIGS. 5-7 show, in cross-section, one embodiment of a voice coil according to this invention, in an extended, centered, and retracted operating position in a motor structure, respectively.
Figure 6:
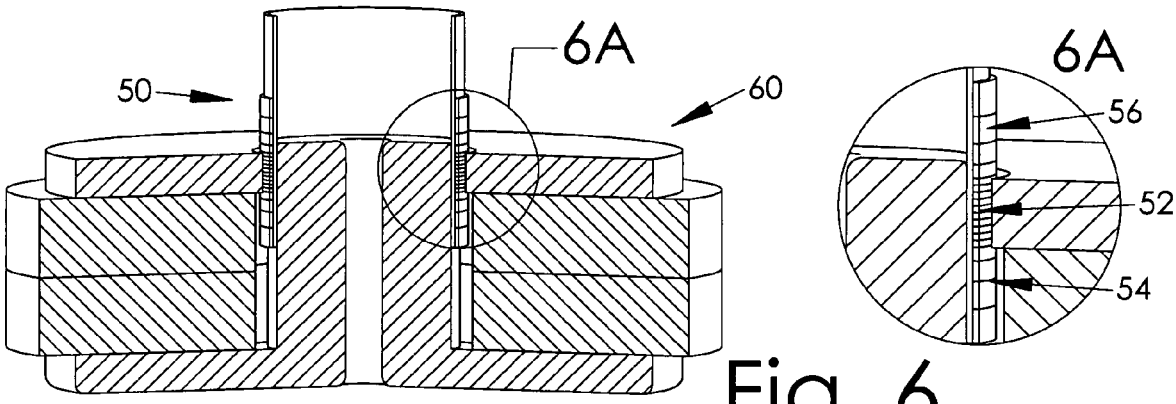
Figure 7:
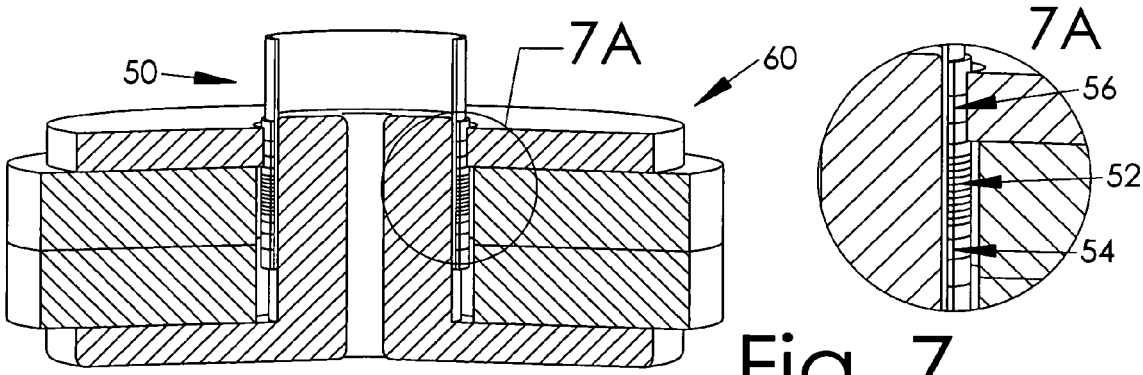

FIGS. 5-7 illustrate an audio speaker driver motor structure 60 according to one embodiment of this invention, using the voice coil of FIG. 4. The motor structure includes a pole plate 12, permanent magnet(s) 20, and a top plate 24 which defines a magnetic air gap 26. A graduated voice coil 50 is coupled to a bobbin 30 and is disposed within the magnetic air gap. In FIG. 5, the voice coil has traveled outward until the central, primary group of windings 52 have left the magnetic air gap. However, a second group of windings 54 remains in the magnetic air gap. In FIG. 6, the voice coil is in a centered position, in which the primary group of windings 52 is in the magnetic air gap. In FIG. 7, the voice coil has traveled inward until the primary group of windings 52 has left the magnetic air gap, and a third group of windings 56 is in the magnetic air gap.

Figure 8:
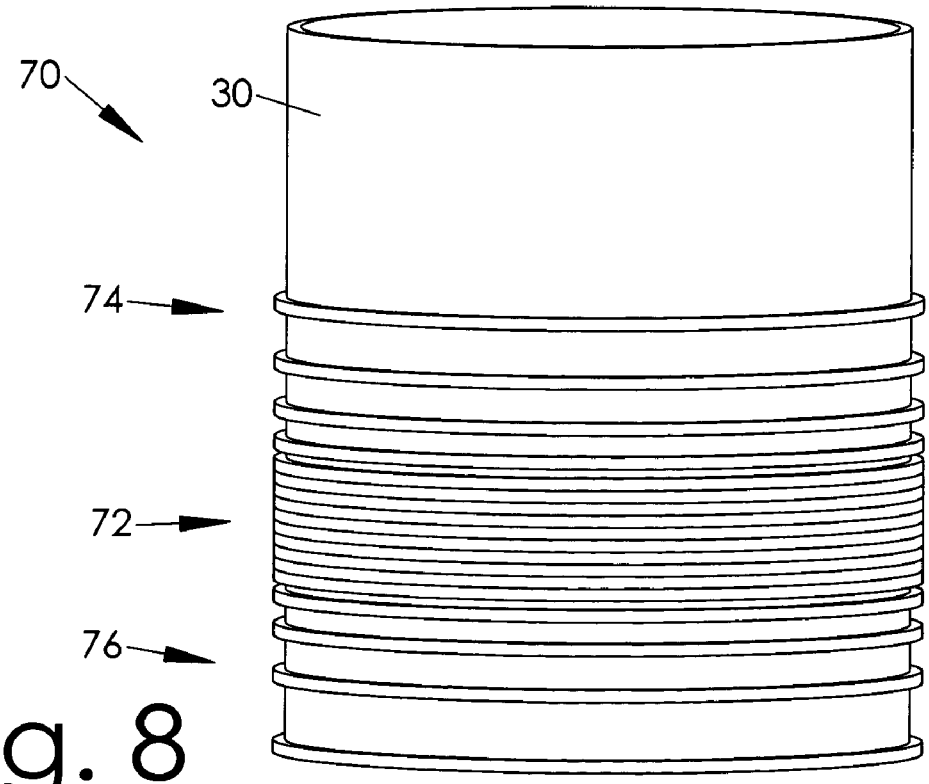
FIG. 8 shows another embodiment of a voice coil having graduated windings according to this invention, in which the wire has a uniform cross-section over its length. Such a voice coil may be utilized in FIGS. 9-11.

FIG. 8 illustrates another embodiment of a graduated voice coil 70 according to this invention. The voice coil includes a central, primary group of windings 72 which are tightly spaced, and one or more secondary groups of windings 74, 76 which are more loosely spaced. In this embodiment, the entire length of the voice coil is made of a constant diameter wire, rather than the tapered wire of FIG. 4. This embodiment does not gain the same measure of electrical resistance reduction as that of FIG. 4, but, conversely, it does not pay the same measure of mass increase as that of FIG. 4.

Hybrid approaches are also workable, in which the cross-sectional area of the wire increases, but not as much as the spacing increases. In some embodiments, there may be more than the two or three groups of windings that have been illustrated here.

The reader will appreciate that the transition from the high-BL mode with the middle portion of the voice coil active, to the lower-BL mode with an outer portion of the voice coil active, will generally not be a step function, but will involve a roll-off transition as the edge of the evenly-wound middle portion exits the magnetic air gap and the total length L within the magnetic air gap begins to diminish.

The graduated winding of the voice coil offers the significant advantage of being able to achieve a tapered transition out of the higher BL linear excursion region into a lower BL region, and the significant advantage of having a greatly reduced electrical resistance of the voice coil (especially with graduated cross-section windings of FIG. 4, as compared to the merely graduated spacing windings of FIG. 8) and high efficiency with very low distortion during low drive level conditions.

When operating the speaker at low sound pressure levels, which need only small amounts of diaphragm excursion, the speaker driver has high efficiency and low distortion. At higher sound pressure levels, which require greater amounts of diaphragm excursion, the speaker driver will enter a region where the average BL has dropped slightly, and the speaker driver will exhibit some degree of non-linearity. However, even though this will result in the high sound pressure level performance having an increase in distortion versus the low sound pressure level performance, the perceived distortion will be significantly less than the actual distortion, because human hearing exhibits a psychoacoustic phenomenon such that distortion of loud sounds is not perceived as well as distortion of quiet sounds.

An optimally designed graduated voice coil will allow a decrease in BL as excursion increases, keeping the rate of distortion increase proportional to the rate of decrease in sensitivity of a human's perception of audible distortion, as sound pressure level (SPL) increases.

Figure 9:
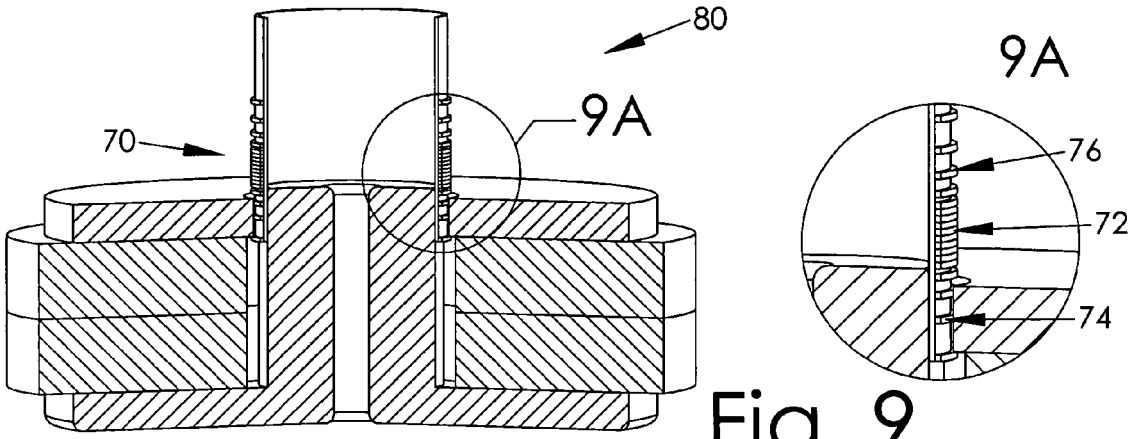
FIGS. 9-11 show, in cross-section, another embodiment of a voice coil according to this invention, in an extended, centered, and retracted operating position in a motor structure, respectively.
Figure 10:
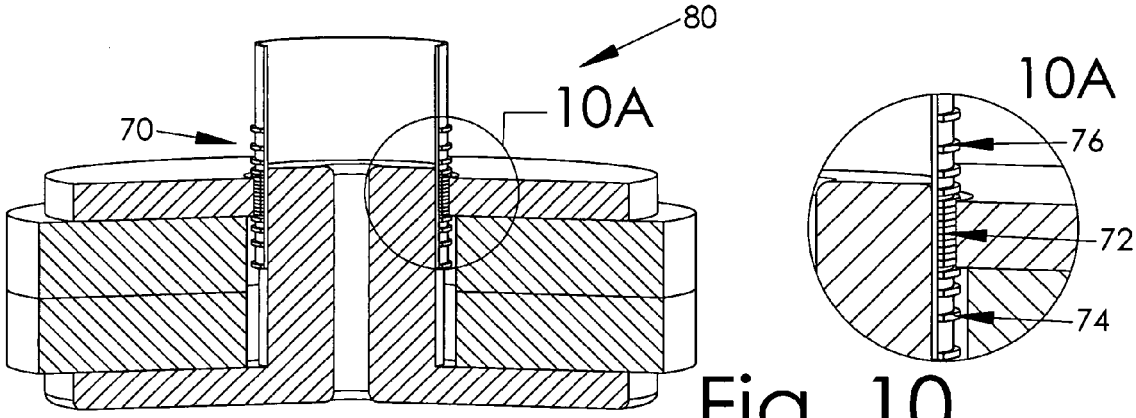
Figure 11:
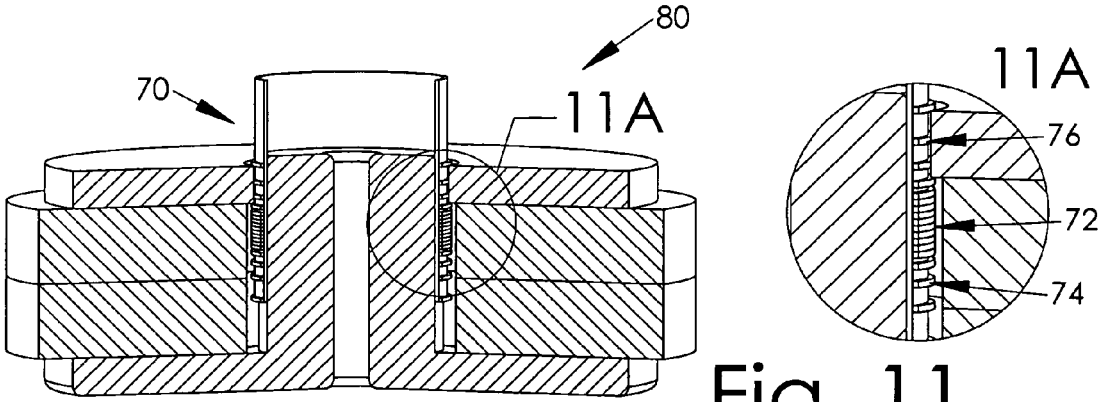

FIGS. 9-11 illustrate an other embodiment of an audio speaker driver motor structure 80, utilizing the voice coil 70 of FIG. 8. In FIG. 9, the voice coil has extended until the primary group of windings 72 has left the magnetic air gap and a second group of windings 74 is in the magnetic air gap. In FIG. 10, the voice coil is centered and the primary group of windings 72 is in the magnetic air gap. In FIG. 11, the voice coil has retracted until the primary group of windings 72 has left the magnetic air gap, and a third group of windings 76 is in the magnetic air gap.

Figure 12:
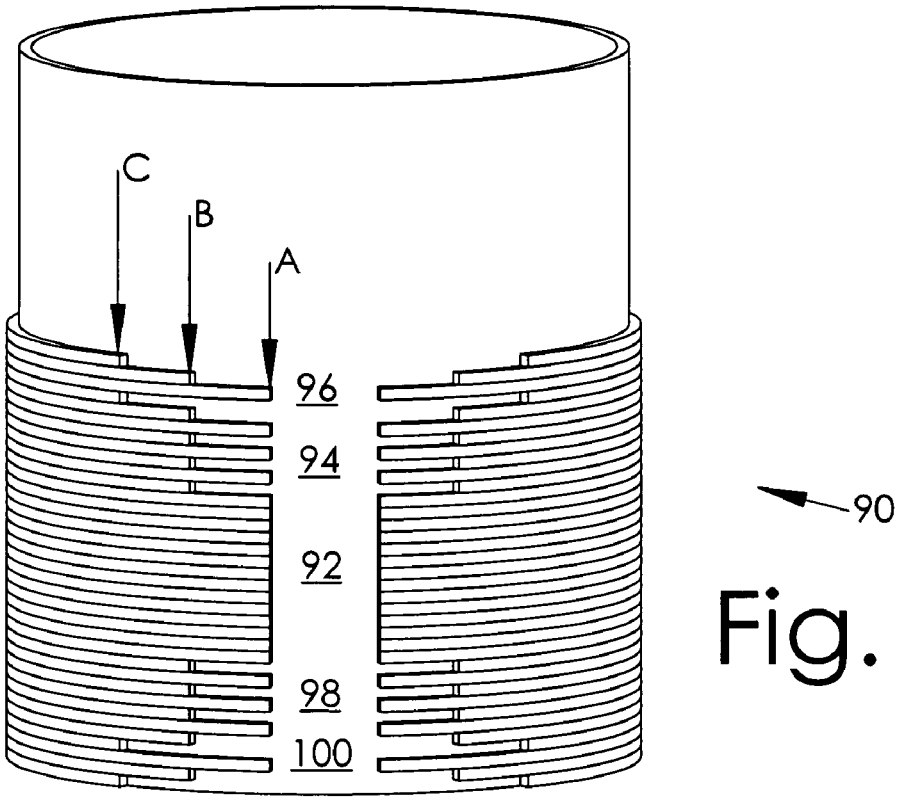
FIG. 12 shows, in partial cross-section, another embodiment of a voice coil having graduated windings, with effectively increasing wire cross-sectional area achieved by splicing and interlacing secondary wires into the voice coil in the looser winding sections of the primary wire.

FIG. 12 illustrates a voice coil 90 according to still another embodiment of this invention. The voice coil is comprised not of a single strand of wire, but of a spliced, forking wire structure. This achieves a similar result as the voice coil of FIG. 4, but in a slightly different manner. A middle portion of the voice coil can be wound from a single strand of wire, and comprises the primary group of windings 92. A next outer portion of the voice coil is wound from two parallel strands of wire, such as by splicing a second wire in at the point where the primary group of windings ends. This portion comprises a second group of windings 94. An outermost portion of the voice coil is wound from three parallel strands of wire, such as by splicing a third wire in at the point where the second group of windings ends. This portion comprises a third group of windings 96. The other end of the voice coil includes its own second group of windings 98 and third group of windings 100, each made by splicing in a separate wire at the appropriate point.

In one embodiment, one side of the voice coil, such as the lower half, does not have the spliced-in sections, and portions 98 and 100 include only the loosely-wound primary wire. This creates an asymmetric voice coil which performs differently in extension than in retraction.

The voice coil is illustrated with three distinct cutaway cuts, each relating to a unique wire. The main wire, which runs the entire course of the voice coil, includes the windings which are cut at point A. The second wire, which runs through the second and third groups of windings, includes the windings which are cut at point B. The third wire, which runs only through the third group of windings, includes the windings which are cut at point C. In this embodiment, the primary group of windings includes windings of the main wire only; thus, its windings are shown as being cut (for illustration purposes only) at cutaway A, A, A, etc. sequentially. In this embodiment, the second group of windings includes alternating windings of the main wire and the second wire; thus, its windings are shown as being cut alternately at A, B, A, B, etc. In this embodiment, the third group of windings includes alternating windings of the main wire, second wire, and third wire; thus, its windings are shown as being cut alternately at A, B, C, A, B, C.

Note that BL is highest when the primary group of windings is in the magnetic air gap; even though the second and third groups have the same number of "loops" of wire per axial unit of height, because adjacent loops in the second and third groups are in parallel, not in series, and thus do not separately contribute to "L".

Figure 13:
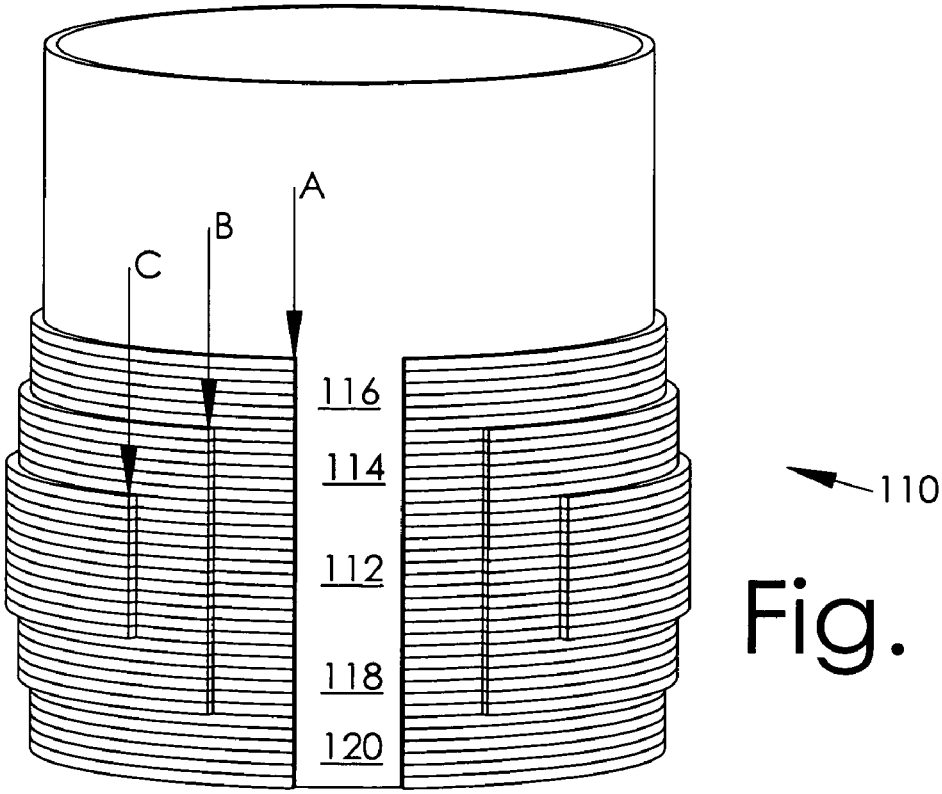
FIG. 13 shows, in cross-section, another embodiment of a voice coil having windings which are graduated radially and axially, by varying the number of layers along the length of the bobbin, or, in other words, by varying the height of the respective layers of windings.

FIG. 13 illustrates a voice coil 110 according to yet another embodiment of this invention. which is graduated in a somewhat different respect. The voice coil includes a first layer of windings, those which are shown at cutaway A, which extend the entire height of the voice coil. The voice coil also includes a second layer of windings, those which are shown at cutaway B, which do not extend to the ends of the first layer of windings. The voice coil optionally also includes a third layer of windings, those which are shown at cutaway C, which extend only over the center portion of the voice coil.

The voice coil includes a primary group of windings 112 which includes windings from all three layers. It also includes a second group of windings 114 which includes windings from all the layers except the outermost (third) layer. It also includes a third group of windings 116 which includes only windings from the innermost (first) layer. The other end of the voice coil may include its own second group of windings 118 and its own third group of windings 120. Although the voice coil is shown as having symmetrical upper and lower ends, in other embodiments they could be asymmetrical.

When the center portion of the voice coil is in the magnetic air gap, BL is at its highest, because there are three layers of windings contributing to "L". As the voice coil extends or retracts and this primary group of windings leaves the magnetic air gap, BL is reduced because there are fewer (and then even fewer) layers of windings contributing to "L". Thus, this embodiment is graduated radially and axially.

FIG. 14 illustrates another embodiment of an audio speaker motor structure 130, which has a hybrid graduated voice coil 132. The voice coil includes a tightly wound, underhung center portion 134 and loosely wound outer portions 136, 138. Even though the center portion is underhung, the overall voice coil is overhung, as illustrated. A significant percentage, and in some cases a majority, of the BL behaves in an underhung manner. Detail view 14 mid illustrates the voice coil centered in the magnetic air gap. Detail view 14 out illustrates the voice coil at its geometric Xmax limit outward excursion position, where the top of the center portion of the voice coil is even with the top of the plate. Detail view 14 far illustrates the voice coil at a position of even greater extension, where the tightly wound center portion has completely left the magnetic air gap (geometrically, ignoring fringing field). In this position, a purely underhung voice coil according to the prior art would be subject to jumpout phenomenon and the sound would be suffering gross distortion.

In one embodiment, the outer portions have ¼ the windings per unit of voice coil height, compared to the tightly wound center portion, the top plate is 15 mm tall, and the center portion of the voice coil is 5 mm tall. In this configuration, when the voice coil is in the position shown in detail 14 far, the voice coil will still have 33% of the BL that it had in the position shown in detail 14 mid (5 mm*1.0 density+10 mm*0.25 density=7.5 units of BL in positions 14 mid to 14 out; 10 mm*0.25 mm density=2.5 units of BL in position 14 far; 2.5/7.5=33%). By comparison, the prior art voice coil would have 0%. (Note that these numbers are based on a geometric simplification which assumes no fringing fields.)

The conventional underhung voice coil BL curve has a very sharp fall-off to zero as the voice coil leaves the magnetic air gap. The hybrid over/underhung voice coil of FIG. 14 has a BL curve with significantly softened edges, greatly extending the amount of excursion before jumpout and/or gross distortion occur.

The hybrid graduated voice coil does have a higher electrical resistance and a higher mass. As illustrated, resistance and mass are both doubled, as compared to a voice coil which includes only the tightly-wound center portion of the windings. However, the loose windings utilize otherwise-unused B to compensate, allowing the efficiency to be nearly as high as the purely underhung voice coil design would be, especially when fringing fields are taken into account.

Furthermore, and especially in embodiments in which the outer portions are wound with larger cross-sectional area wire (such as in FIG. 4), the hybrid voice coil will have significantly improved heat dissipation, and thus markedly improved instantaneous power handling ability (in the 1$^{st}$ time constant). The large outer windings have very low electrical resistance and thus contribute minimally to resistive heating of the voice coil. Rather, with their large, thermally conductive mass positioned adjacent to the higher resistance, tighter inner winding portion of the voice coil, they serve as a heatsink, drawing heat away from the inner winding portion. Then, their large surface area serves to efficiently pass that heat to the air and other surroundings.

FIG. 15 illustrates yet another embodiment of an audio speaker motor structure 140 which uses a graduated voice coil 142. The voice coil includes tightly wound inner portions 144 and 146 and loosely wound outer portions 148 and 150. This embodiment differs from others in that the tightly wound inner portions surround a loosely wound centralmost portion 152. In FIG. 15, cross-hatching has been applied to the voice coil windings (in opposite directions for the loose portions and the tight portions) and to the bobbin, to make the detail views more easily understood.

In one embodiment, the top plate is 20 mm tall, and each of the five portions of the voice coil is 10 mm tall. If the centralmost portion 152 of the voice coil had the same winding density as the tightly would portions 144 and 146, there would be a 30 mm overhung central portion, and a geometric Xmax of 5 mm (not counting the contribution of the outer portions). However, by interrupting the tightly wound portion with the loosely wound central portion (which, ideally, is wound equally loosely as are the outer portions), the geometric Xmax is extended to 15 mm. Detail view 15 mid illustrates the voice coil centered. Detail view 15 some illustrates the voice coil extended 5 mm, where Xmax would end if not for the loose windings of the centermost portion of the voice coil. Detail view 15 out illustrates the voice coil extended 15 mm (10 mm beyond detail view 15 some), at the geometric Xmax limit.

BL has been slightly compromised, in the interest of greatly increasing Xmax for a given voice coil DCR and/or coil mass. If the loose portions are ½ as tightly wound as the tight portions, BL has been reduced 25% (10 mm*1.0 density+10 mm*0.5 density=1.5 units of BL; versus 20 mm*1.0 density=2.0 units of BL without the looser centermost portion), but Xmax has been tripled (15 mm versus 5 mm), and the DCR and mass have increased by 16.7%. In many applications, this will be a most acceptable tradeoff.

Figure 16:
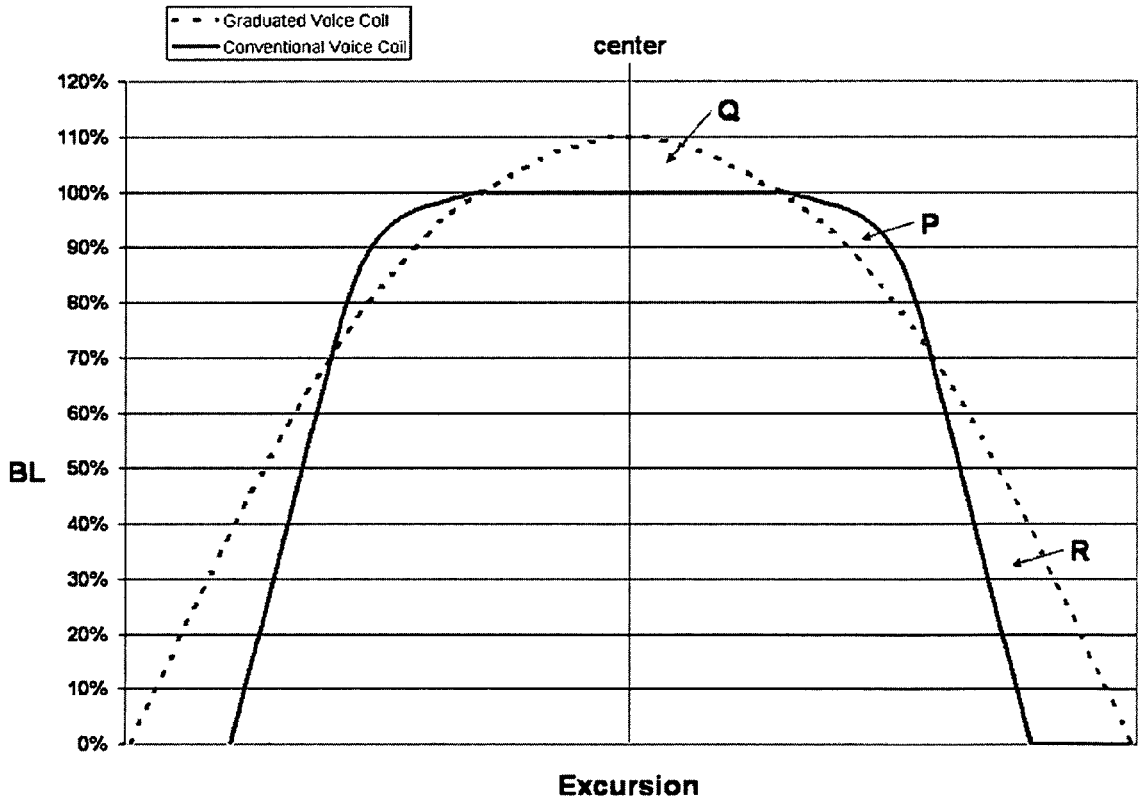
FIG. 16 shows an illustrative graph comparing the linearity over excursion, of a conventional audio speaker driver and an audio speaker driver according to this invention.

FIG. 16 shows a chart illustrating BL/excursion curves, comparing two voice coils: a voice coil according to a symmetrical permutation of this invention, and a conventional voice coil. The solid line curve represents the BL/excursion performance of an audio speaker driver using a conventional, non-graduated voice coil. The dashed line curve represents the BL/excursion performance of an audio speaker driver using a voice coil with increased L in the center (such as those of FIG. 4 or 8). The increased center L voice coil trades Xmax to gain small excursion efficiency by raising small excursion BL; in other words, it sacrifices region P to gain region Q (and region R) in the graph. Yet, it does retain a useful amount of BL under high excursion, to help prevent the onset of gross distortion.

CONCLUSION

Reference in the specification to "an embodiment," "one embodiment," "some embodiments," or "other embodiments" means that a particular feature, structure, or characteristic described in connection with the embodiments is included in at least some embodiments, but not necessarily all embodiments, of the invention. The various appearances "an embodiment," "one embodiment," or "some embodiments" are not necessarily all referring to the same embodiments. When one component is said to be "adjacent" another component, it should not be interpreted to mean that there is absolutely nothing between the two components. Features described with reference to a particular embodiment are not necessarily limited to inclusion in only that embodiment. The several features illustrated in the various figures may be combined in many ways.

Speaker drivers may generally be classified as having an external magnet geometry (in which an annular magnet and an annular plate surround a pole) or an internal magnet geometry (in which a magnet and a plate are disposed within a cup). Pole plates and cups may collectively be termed magnetic return path members or yokes, as they serve as the return path for magnetic flux which has crossed over the magnetic air gap. While the invention has been described with reference to external magnet geometry speaker drivers, this is for convenience only, and is not a limitation on the use of the invention.

The phrase "magnetic air gap" is not intended to imply any limitation that the gap is actually filled with air, and is merely a term of art; the gap could, in some applications, be filled with any suitable gas or liquid such as magnetic fluid, or even be under vacuum.

The phrase "geometric Xmax" refers to the maximum one-way excursion of the voice coil (from the resting position), which maintains a constant number of turns in a simplified magnetic air gap model that assumes there are no fringing fields above or below the gap.

While the invention has been described with reference to moving voice coil transducers, it can also be used in moving magnet transducers.

Those skilled in the art having the benefit of this disclosure will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An audio speaker driver comprising:

(A) a motor structure having a magnetic circuit including a magnetic air gap; and (B) a voice coil assembly disposed within the magnetic air gap and including, (1) a bobbin, and (2) a voice coil coupled to the bobbin, wherein the voice coil includes, (a) a center set of voice coil windings of wire wound about a center portion of the bobbin, and (b) an outer set of voice coil windings of wire wound about outer portions of the bobbin above and below the center portion, (c) wherein in at least one of, (i) the center set of voice coil windings has a higher average electrical resistance per unit of voice coil height than the outer set of voice coil windings, and (ii) the center set of voice coil windings has a longer average length L per unit of voice coil height than the outer set of voice coil windings.

2. The audio speaker driver of claim 1 wherein both:

the center set of voice coil windings has a higher average electrical resistance per unit of voice coil height than the outer set of voice coil windings; and the center set of voice coil windings has a longer average length L per unit of voice coil height than the outer set of voice coil windings.

3. The audio speaker driver of claim 1 wherein:

the center set of voice coil windings has a tighter on-center spacing than the outer set of voice coil windings.

4. The audio speaker driver of claim 1 wherein:

wire in the center set of voice coil windings has a smaller cross-sectional area than wire in the outer set of voice coil windings.

5. The audio speaker driver of claim 4 wherein:

the center set of voice coil windings has a tighter on-center spacing than the outer set of voice coil windings.

6. The audio speaker driver of claim 1 wherein:

the center set of voice coil windings has a greater number of winding layers than the outer set of voice coil windings.

7. The audio speaker driver of claim 1 wherein the voice coil further includes:

a third set of voice coil windings wound about third portions of the bobbin outside the outer portions of the bobbin, wherein at least one of, (i) the third set of voice coil windings has lower average electrical resistance per unit of voice coil height than the outer set of voice coil windings, and (ii) the third set of voice coil windings has shorter average length L per unit of voice coil height than the outer set of voice coil windings.

8. The audio speaker driver of claim 1 wherein the voice coil comprises:

a wire having at least one of, a varying cross-sectional area over the wire's length, and a varying on-center winding spacing over the wire's length.

9. The audio speaker driver of claim 8 wherein the voice coil comprises:

a wire having at least one of, a continuously varying cross-sectional area over the wire's length, and a continuously varying on-center winding spacing over the wire's length.

10. The audio speaker driver of claim 1 wherein:

the center set of voice coil windings includes a primary wire;

the outer set of voice coil windings includes the primary wire and a secondary wire wound in an interlaced, parallel configuration with the primary wire.

11. The audio speaker driver of claim 1 wherein:

the center set of voice coil windings are underhung with respect to the magnetic air gap; and the voice coil as a whole is overhung with respect to the magnetic air gap.

12. The audio speaker driver of claim 1 further comprising:

a centermost set of voice coil windings wound about a centermost portion of the bobbin so as to divide and separate the center set of voice coil windings into an upper portion and a lower portion;

wherein the centermost set of voice coil windings has at least one of a lower average electrical resistance and a shorter average length L per unit of voice coil height than the center set of voice coil windings.

13. The audio speaker driver of claim 12 wherein:

the centermost set of voice coil windings has at least one of a same average electrical resistance and a same length L per unit of voice coil height as the outer set of voice coil windings.

14. The audio speaker driver of claim 12 wherein:

when the upper portion of the center set of voice coil windings is substantially centered about a geometric top of the magnetic air gap, the lower portion of the center set of voice coil windings is substantially centered about a geometric bottom of the magnetic air gap.

15. An audio speaker driver comprising:

a magnetic circuit including a magnetic air gap; and a voice coil assembly disposed within the magnetic air gap and including, a bobbin, center voice coil windings of wire having a first spacing, arid outer voice coil windings of wire above and below the center voice coil windings and having a second spacing looser than the first spacing.

16. The audio speaker driver of claim 15 wherein the voice coil assembly further comprises:

a third portion of voice coil windings above and below the outer voice coil windings and having a third spacing looser than second spacing.

17. The audio speaker driver of claim 15 wherein the voice coil assembly further comprises:

a third portion of voice coil windings substantially at a middle of the center voice coil windings and having a third spacing looser than first spacing.

18. The audio speaker driver of claim 15 wherein:

the voice coil comprises a wire having a graduated rectangular cross-section.

19. A voice coil assembly for use in an audio speaker driver, the voice coil assembly comprising:

a bobbin; and a wire wound around the bobbin into, a center portion having a first on-center spacing, and an outer portion at least one of above and below the center portion and having a second on-center spacing looser than the first on-center spacing.

20. The voice coil assembly of claim 19 further comprising:

a third portion of voice coil windings outside the outer portion and having a third on-center spacing looser than the second on-center spacing.

21. The voice coil assembly of claim 19 wherein:

the outer portion is both above and below the center portion.

22. The voice coil assembly of claim 19 wherein:

the wire has a rectangular cross-section.

23. A method of operating an audio speaker driver, the method comprising:

conducting magnetic flux over a magnetic air gap in a magnetic circuit including a magnet, a drive plate, and a magnetic return path member; and conducting an alternating electric current through a voice coil which comprises wire wound in a graduated pattern around a bobbin, wherein the graduated pattern includes upper and lower outer portions, and a center portion wound on tighter on-center spacing than the outer portions.

24. The method of 23 further comprising:

in response to the alternating electric current being conducted through the voice coil when the center portion of the voice coil's windings are disposed within the magnetic air gap, moving the voice coil under a first amount of electromotive force; and in response to the alternating electric current being conducted through the voice coil when one of the upper and lower portions of the voice coil's windings are disposed within the magnetic air gap, moving the voice coil under a second amount of electromotive force lower than the first amount of electromotive force.

25. The method of 24 further comprising:

when the center portion of the voice coil's windings are disposed within the magnetic air gap, operating the audio speaker in a substantially linear excursion mode; and when one of the upper and lower portions of the voice coil's windings are disposed within the magnetic air gap, operating the audio speaker in a mode which is less linear and less efficient than the linear excursion mode.

* * * * *